United States Patent [19]

Fourreau et al.

[11] Patent Number: 4,458,970

[45] Date of Patent: Jul. 10, 1984

[54] ELECTRICAL CONTACT AND CONNECTOR USING SUCH CONTACTS

[75] Inventors: Yves Fourreau; Michel Pesson; Alain Gillet, all of Le Mans, France

[73] Assignee: Souriau & Cie., Boulogne, France

[21] Appl. No.: 435,620

[22] Filed: Oct. 20, 1982

[30] Foreign Application Priority Data

Oct. 23, 1981 [FR] France ..... 81 19899

[51] Int. Cl.[3] ..... H01R 13/38

[52] U.S. Cl. ..... 339/31 M; 339/99 R

[58] Field of Search ..... 339/31–33, 339/97 R, 97 P, 98, 99 R, 195 A, 196 A

[56] References Cited

U.S. PATENT DOCUMENTS

| | | | |
|---|---|---|---|
| 1,530,011 | 3/1925 | Pacent | 339/31 R |
| 4,351,582 | 9/1982 | Emerson et al. | 339/97 P |
| 4,417,780 | 11/1983 | Knapp | 339/99 R |
| 4,418,977 | 12/1983 | O'Shea, Jr. | 339/99 R |

*Primary Examiner*—Joseph H. McGlynn

*Attorney, Agent, or Firm*—McAulay, Fields, Fisher, Goldstein & Nissen

[57] ABSTRACT

An electrical contact comprises first and second interconnectable portions (41 and 42), said first portion (41) including a tab (2) for connection to an electrical conductor by relative movement of said tab and said conductor along a first axis (3). A pin (6) is rigidly fixed to said tab and extends along a second axis (7) parallel to said first axis and offset therefrom by a first predetermined offset ($\alpha$). Said second contact portion (42) comprises a head (8) suitable for receiving said first portion in a plurality of positions relative a third axis (14). Said third axis constitutes a middle axis of said second contact portion, and said first portion is receivable at a plurality of distances up to a second predetermined offset on either side of said third axis. Said first and second predetermined offsets are substantially equal, and said head has a connector member (15) extending therefrom along a fourth axis which is substantially the same as said third axis. The idea is to put a connector at a connector pitch on the end of a ribbon cable having conductors disposed at a slightly different cable pitch.

10 Claims, 6 Drawing Figures

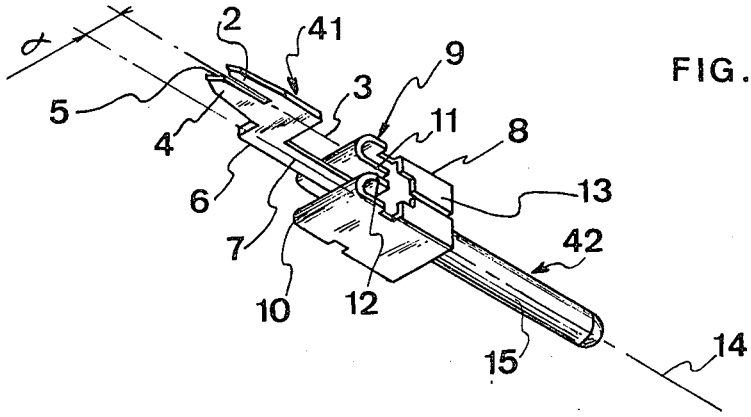
FIG. 1
FIG. 2
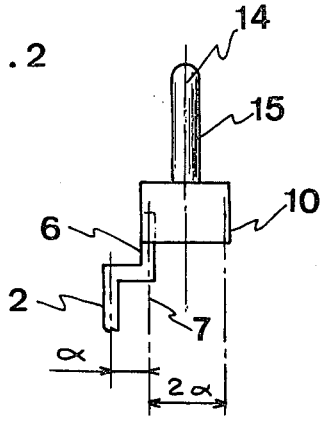
FIG. 3
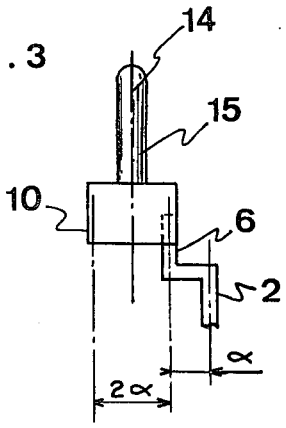
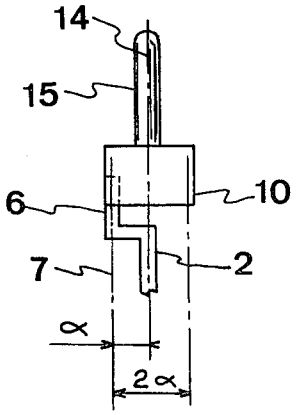
FIG. 4
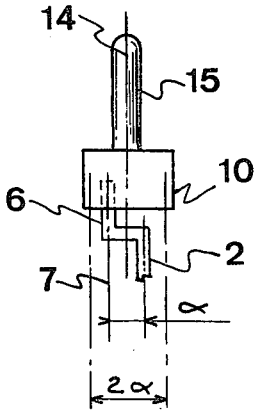
FIG. 5

ELECTRICAL CONTACT AND CONNECTOR USING SUCH CONTACTS

The present invention relates to electrical contacts, and to their use in a connector.

BACKGROUND OF THE INVENTION

Current technology has produced a number of specially shaped cables including flat, layered or ribbon cables.

Such cables comprise a plurality of electrical conductors arranged side-by side, and they are frequently used in many kinds of industry. They are generally fitted with connectors so that the cables can readily be connected and disconnected to other equipment.

There is therefore a requirement for connectors suitable for fixing to such cables. Such connectors must be capable of being male, female, or hermaphrodite according to the needs of the equipment with which they are to be mated.

There has also been considerable work, on an international scale, to define connector standards to enable equipment having connector portions made by a first manufacturer to be mated with equipment having corresponding connector portions made by a second manufacturer, with the manufacturers frequently being located in different countries or in different continents.

Unfortunately, there is no guarantee that connectors made to conform with one set of standards, e.g. concerning the pitch of electrical contacts, will match cables made to conform to some other set of standards. Thus, it is not uncommon for the pitch of the conductors in a cable to be different from the pitch of the contacts in a connector to be fitted to the end of the cable.

Further, connectors may need to be fitted to various cables of different pitches, so that the cable pitch is sometimes greater than the connector pitch, sometimes equal therto, and sometimes smaller than the connector pitch.

To cope with this problem, electrical contacts have been devised (together with connectors including such contacts) where the contacts include an elongate deformable member having a portion at a first end suitable for mating to a corresponding connector, and a portion at a second or opposite end suitable for connection to the conductor of a ribbon cable. The intermediate portion of the member is a deformable rod whereby a row of first ends can be arranged at the pitch of the connector, while a row of second ends can simultaneously be arranged at the pitch of conductors in the cable.

This results in the contacts being progressively more and more deformed going away from a minimally deformed region of the connector.

While a connector of the type described above serves the purpose of matching two different conductor pitches, it suffers from two drawbacks: firstly there is a mechanical problem of obtaining an even pitch by applying a progressively different amount of twist to the deformable members; and secondly there is a relatively small range of pitch differences over which twisting can be effective, before the amount of twist required of the extreme deformable members becomes excessive.

Preferred embodiments of the present invention provide a contact and a connector using a plurality of such contacts, in which any conductor offset between two limit values is relatively easy to obtain, and wherein contacts providing extreme value offsets are not at any disadvantage to contacts with substantially no offset.

SUMMARY OF THE INVENTION

In one aspect the present invention provides an electrical contact comprising first and second interconnectable portions, said first portion comprising a tab for connection to an electrical conductor by relative movement of said tab and said conductor along a first axis, and a pin which is rigidly fixed relative said tab and which extends along a second axis parallel to said first axis and offset therefrom by a first predetermined offset, said second contact portion comprising a head suitable for receiving said first portion in a plurality of positions relative a third axis, said third axis constituting a middle axis of said second contact portion, and said first portion being receivable at a plurality of distances up to a second predetermined offset on either side of said third axis, said first and second predetermined offsets being substantially equal, and said head having a connector member extending therefrom along a fourth axis which is substatially the same as said third axis.

In another aspect the present invention provides a connector including a plurality of contacts as defined above.

BRIEF DESCRIPTION OF THE DRAWINGS

Embodiments of the invention are described by way of example with reference to the accompanying drawings, in which:

FIG. 1 is a perspective view of an electrical contact in accordance with the invention;

FIGS. 2 to 5 are diagrams showing the contact of FIG. 1 at a variety of different offsets.

MORE DETAILED DESCRIPTION

Figure 6:
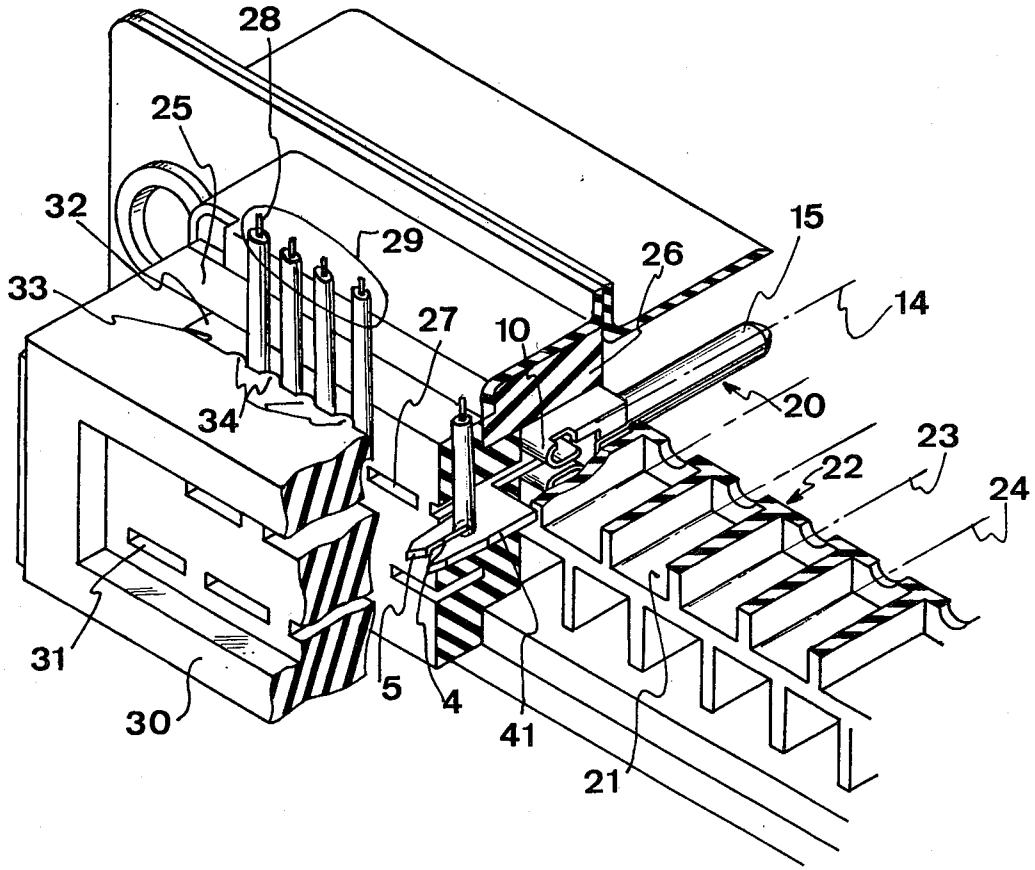
FIG. 6 is a partially cut away view of a connector including a plurality of contacts as shown in FIG. 1.

FIG. 1 is a perspective view of an electrical contact comprising first and second contact portions 41 and 42 which are interconnectable to form an electrical contact.

In particular, the first portion 41 comprises a slotted contact tab 2 made of an electrically conductive material. The tab 2 has a slot 4 extending along an axis 3 from a tapering mouth 5, and is designed to be connected to an insulated conductor wire 28 (see FIG. 6) by moving the wire along the axis 3 into the slot 4 from the tapering mouth 5. The movement of the wire 28 along the slot 4 causes the insulation to be cut and electrical contact to be established by the tab 2 biting the wire.

The contact portion 41 further includes an elongate pin 6 which is in one piece with the tab 2 and which extends along an axis 7 which is substantially parallel to the axis 3, but which is offset therefrom by a distance denoted $\alpha$.

The entire contact portion 41 may be manufactured by stamping out from a sheet of flat metal which is thick enough to ensure that the resulting contact portion 41 is sufficiently rigid.

The second contact portion 42 comprises a head 8 having an end 9 in the form of a grip 10 made up from two resilient lips 11 and 12. The lips may be pre-stressed in order to obtain the required resilience, and they tend towards a closed position for the grip. The lips 11 and 12 are in the form of projecting ends of respective sheet metal members whose other ends are rigidly mounted to a block 13. A shaft 15 projects from the block 13 in the opposite direction from the lips 11 and 12. The shaft 15 serves as a male connector portion for mating with a female connector portion (not shown) forming part of a connector having contacts at some standard pitch for connectors. Clearly any other form of connector portion could be used instead of the shaft 15, e.g. a female connector portion, or a hermaphrodite connector portion.

In the embodiment shown, the shaft 15 extends along a middle axis 14 of the contact portion 42, while the lips 11 and 12 co-operate along a contact line which extends at right angles to said middle axis 14. The lips extend over a distance $\alpha$ on either side of said middle axis 14, i.e. they are $2\alpha$ wide.

The two contact portions 41 and 42 may be interconnected as shown in FIG. 1, i.e. the pin 6 of the portion 41 is inserted in the grip 10 in such a manner that the lips 11 and 12 are resiliently pressed against the sides of the pin 6, with the flat sides of the pin 6 and the relatively broad width of the lips 11 and 12 ensuring that the contact portion 41 is held substantially rigidly relative to the contact portion 42.

The advantage of the contact shown in FIG. 1 stems from the fact that the pin 6 may be placed between the lips 11 and 12 anywhere over their width such that there may be an offset of up to $\alpha$ between the middle axis 14 and the axis 7 of the pin 6. Further, by suitably orienting the contact portion 41 before inserting it into the contact portion 42, the offset between the axis 3 and the axis 7 may be added to or subtracted from the offset between the axes 7 and 14. The overall result is that the offset of the axis 3 may be any desired amount up to $2\alpha$ on either side of the axis 14, which naturally includes the possibility of said axes being aligned with each other.

Reference is now made to FIGS. 2 to 5 which are diagrams showing the FIG. 1 contact assembled in various configurations.

At one extreme, the pin 6 is inserted at the edge of the grip 10 with the tab 2 offset even further in same direction. This gives a total offset of $2\alpha$ between the axes 3 and 14, as can be seen in FIG. 2.

FIG. 3 shows essentially the same configuration as FIG. 2 except that the offset is in the opposite direction, giving a total range of $4\alpha$ between extreme positions.

The net result is that a conductor covered by a more or less inflexible covering, can still be connected to the shaft 5, providing its covering brings it to within $2\alpha$ of the shaft axis 14.

Naturally, it is possible to connect the shaft 15 to wires that are in between the extreme positions described above. Thus, by inserting the pin 6 into the edge of the grip 10, but with the first contact portion 41 turned so that the offset between the axes 7 and 3 is subtracted from the offset between the axes 7 and 14, it is possible to connect the shaft 15 to a wire that lies in the axis 15 of the shaft. This is the position shown in FIG. 4.

Finally, FIG. 5 shows a configuration in between those of FIGS. 3 and 4, in which the pin 6 is inserted into the grip 10 at a point part way along its width.

An electrical contact of the type described above is advantageous in a strip connector comprising a plurality of contacts disposed side-by-side in an insulating support. FIG. 6 is a partially cut away perspective view of such a connector.

The connector comprises a plurality of contacts 20 identical to the contact described with reference to FIGS. 1 to 5. In order to simplify the drawing, only one such contact 20 is visible in FIG. 6, but a plurality of contact-receiving sockets 21 are visible in a base member 22.

Such a connector can be connected to a flat, layered or ribbon cable having conductors at a pitch which is different from the standardised pitch between contacts, as shown in FIG. 6 by the spacing between two axes 23 and 24.

Given the pitch of the conductors in the cable, and the pitch of the contacts in the connector, it is possible to assemble each pair of contact portions 41 and 42 in such a manner as to put the shafts 15 at the connector pitch while the slots 4 are at the cable pitch.

In outline, the procedure is to arrange for the middle contacts in the connector to have their respective portions aligned, with the contacts to either side thereof being gradually more and more offset. Putting the distance between two adjacent contacts as X and the distance between two adjacent cable conductors as Y, where X differs from Y, but not by very much, the first contact portions 41 need to be inserted into the grips 10 of the second contact portions 42 in such a manner that the first portions 41 are regularly spaced with a distance Y between centers in spite of the second portions 42 being regularly spaced by the insulator base 22 with a distance X between centers.

Naturally there are limits to the amount of pitch difference that can be absorbed in this way. Generally speaking the number of conductors that can be accommodated is given by the equation:

$$2\frac{2\alpha}{|Y-X|}+1$$

where the factor of two comes from the fact that the same number of contacts can be arranged on either side of the middle contact.

In FIG. 6 the base 22 is shown as an assembly of two pieces 25 and 26 which fit together in such a manner as to retain the bodies 8 of the contact portions 42 in the sockets 21, and to retain the relatively flat contact portions 41 in slots 27 provided for the purpose. The slots 27 are the same width as the contact portions 41, thereby holding them fairly rigidly, but allowing the slotted ends thereof to project from the slots 27. The conductors 28 of a cable 29 are then placed over the connector piece 25 in such a way as to align one conductor of the cable with each projecting slotted end of a tab 2. Once the conductors are ready in place over the tapered openings 5 to the slots 4, a cover 30 having slots 31 corresponding to the slots 27 is brought against the piece 25, sandwiching the cable 29. By pressing the cover 30 towards the piece 25, the conductors are pushed into the slots 4, thereby establishing electrical contact between the contact potions 41 and the corresponding conductors 28, and also providing mechanical support for the conductors 28 where they are pressed between facing faces 32 and 33 on the piece 25 and on the cover 30 respectively.

A series of ridges 34 is provided on the cover face 33 to help locate the conductor wires. Naturally, such ridges could have been on the corresponding face 32 of the piece 25, or on both said faces.

We claim:

1. An electrical contact comprising first and second interconnectable portions, said first portion comprising a tab for connection to an electrical conductor by relative movement of said tab and said conductor along a first axis, and a pin which is rigidly fixed relative said tab and which extends along a second axis parallel to said first axis and offset therefrom by a first predetermined offset, said second contact portion comprising a head suitable for receiving said first portion in a plurality of positions relative a third axis, said third axis constituting a middle axis of said second contact portion, and said first portion being receivable at a plurality of distances up to a second predetermined offset on either side of said third axis, said first and second predetermined offsets being substantially equal, and said head having a connector member extending therefrom along a fourth axis which is substatially the same as said third axis.

2. An electrical contact according to claim 1, wherein said tab has a slot running along said first axis, and means for cutting into an insulating covering on a conductor.

3. An electrical contact according to claim 1, wherein said connector member comprises a male elongate connector member.

4. An electrical contact according to claim 1, wherein said connector member comprises a female elongate connector member.

5. An electrical contact according to claim 1, wherein said head comprises a solid block and gripping means fixed thereto, said gripping means having a width substantially twice said predetermined offset.

6. An electrical contact according to claim 5, wherein said griping means comprises a pair of resilient prestressed lips fixed to said solid block.

7. An electrical connector including a plurality of electrical contacts according to claim 1.

8. An electrical connector according to claim 7, wherein said electrical contacts are housed in sockets arranged side-by-side in a base member.

9. An electrical connector according to claim 8, wherein said contacts project from opposite sides of said base member, with at least a portion of their contact tabs projecting from one side, and a portion of their connector members projecting from the opposite side.

10. An electrical connector according to claim 9, comprising a cover suitable for covering the projecting portions of the tabs.

* * * * *